United States Patent [19]

Collins et al.

[11] Patent Number: 5,053,119

[45] Date of Patent: Oct. 1, 1991

[54] ORE FLOTATION

[75] Inventors: Douglas N. Collins, Hitchin; John D. Collins, Albrighton, both of England

[73] Assignee: Albright & Wilson Limited, Warley, England

[21] Appl. No.: 634,803

[22] Filed: Dec. 28, 1990

Related U.S. Application Data

[63] Continuation of Ser. No. 539,320, Jun. 13, 1990, abandoned, which is a continuation of Ser. No. 418,913, Oct. 5, 1989, abandoned, which is a continuation of Ser. No. 298,842, Jan. 18, 1989, abandoned, which is a continuation of Ser. No. 178,886, Mar. 31, 1988, abandoned, which is a continuation of Ser. No. 54,075, May 21, 1987, abandoned, which is a continuation of Ser. No. 879,529, Jun. 23, 1986, abandoned, which is a continuation of Ser. No. 793,716, Oct. 30, 1985, abandoned, which is a continuation of Ser. No. 703,466, Feb. 21, 1985, abandoned, which is a continuation of Ser. No. 594,572, Mar. 29, 1984, abandoned.

[30] Foreign Application Priority Data

Mar. 29, 1983 [GB] United Kingdom ..... 8308639
Feb. 28, 1984 [GB] United Kingdom ..... 8405133

[51] Int. Cl.[5] ..... B03D 1/014; B03D 1/02
[52] U.S. Cl. ..... 209/166; 252/61
[58] Field of Search ..... 209/166, 167; 252/61

[56] References Cited

U.S. PATENT DOCUMENTS

| | | | |
|---|---|---|---|
| 2,400,213 | 5/1946 | Schilling . | |
| 4,040,051 | 8/1977 | Fukazawa . | |
| 4,040,519 | 8/1977 | Fukazawa | 209/166 |
| 4,070,276 | 1/1978 | Broman | 209/166 |
| 4,144,969 | 3/1979 | Snow . | |
| 4,358,368 | 11/1982 | Hellensten | 209/167 |
| 4,363,724 | 12/1982 | Panzer . | |
| 4,421,641 | 12/1983 | Blazy | 209/166 |
| 4,450,116 | 5/1984 | Morawietz | 209/166 |
| 4,482,454 | 11/1984 | Decuyper | 209/166 |

FOREIGN PATENT DOCUMENTS

| | | | |
|---|---|---|---|
| 458428 | 7/1949 | Canada | 209/166 |
| 70534 | 1/1983 | European Pat. Off. | 209/166 |
| 8202972 | 4/1984 | Finland | 209/166 |
| 2497467 | 7/1982 | France | 209/166 |
| 836784 | 9/1983 | South Africa | 209/166 |
| 523714 | 9/1976 | U.S.S.R. | 209/166 |
| 605638 | 4/1978 | U.S.S.R. | 209/166 |
| 624652 | 8/1978 | U.S.S.R. | 209/166 |
| 645708 | 2/1979 | U.S.S.R. | 209/166 |
| 650657 | 3/1979 | U.S.S.R. | 209/166 |
| 772595 | 10/1980 | U.S.S.R. | 209/166 |
| 818653 | 4/1981 | U.S.S.R. | 209/166 |
| 839574 | 6/1981 | U.S.S.R. | 209/166 |
| 871832 | 10/1981 | U.S.S.R. | 209/166 |
| 988344 | 1/1983 | U.S.S.R. | 209/166 |
| 2137903 | 10/1984 | United Kingdom | 209/166 |
| 2156819 | 10/1985 | United Kingdom | 209/166 |

*Primary Examiner*—Stanley S. Silverman
*Assistant Examiner*—Thomas M. Lithgow
*Attorney, Agent, or Firm*—Frishauf, Holtz, Goodman & Woodward

[57] ABSTRACT

Ores of metal oxides and oxide-like compounds such as chromite and pyrochlore are beneficiated by froth flotation in the presence of substituted amino phosphonic acids or salts thereof.

15 Claims, No Drawings

ORE FLOTATION

This application is a continuation of Ser. No. 07/539,320 filed June 13, 1990 (abandoned); which is a continuation of Ser. No. 07/418,913 filed Oct. 5, 1989 (abandoned); which is a continuation of Ser. No. 07/298,842 filed Jan. 18, 1989 (abandoned); which is a continuation of Ser. No. 07/178,886 filed Mar. 31, 1988 (abandoned); which is a continuation of Ser. No. 07/054,075 filed May 21, 1987 (abandoned); which is a continuation of Ser. No. 06/879,529 filed June 23, 1986 (abandoned); which is a continuation of Ser. No. 06/793,716 filed Oct. 30, 1985 (abandoned); which is a continuation of Ser. No. 06/703,466 filed Feb. 21, 1985 (abandoned); which is a continuation of Ser. No. 06/594,572 filed Mar. 29, 1984 (abandoned).

BACKGROUND OF THE INVENTION

The present invention relates to phosphonic acids and to the beneficiation therewith of ores particularly oxide ores by flotation.

BACKGROUND INFORMATION

Hitherto, beneficiation of many oxide ores have been carried out by gravity. means or, in the cases of cassiterite, by flotation techniques. However, in many case it has not proved possible commercially to purify many oxide ores by froth flotation.

SUMMARY OF THE INVENTION

We have found certain substituted amino phosphonates which are highly effective as flotation agents for oxide ores, and oxide like ores.

The amino phosphonates are substituted amino phosphonic acids (and their water soluble salts) having the general formula $R_aR^1_bR^2_cN(R^3PO_3H_2)_{3-a-b-c}$ especially $RN(CH_2PO_3H_2)_2$, where each of R, $R^1$ and $R^2$ is an organic group, e.g. optionally substituted alkyl or alkenyl group of 1–20 carbon atoms or an aryl, aralkyl, cycloaliphatic or cycloaliphatic alkyl group, and $R^3$ is a divalent organic group, e.g. alkylene, alkylidene, cyclohexylidene or benzylidene, each of a, b and c is 0 or 1, but when a is 1, b and c are 0, and when a is 0, b and c are 1. These compounds may be made by reacting a primary amine of formula $RNH_2$ or a secondary amine of formula $R^1R^2NH$ with formaldehyde or an aldehyde or ketone of formula $R^3O$, in which the two valencies are on the same carbon atom, and phosphorous acid or a phosphorus trihalide under acid condition, and subsequently if desired adding a base to make the salt. When the free valencies in the $R^3$ group are attached to different carbon atoms, the compounds may be made from the amines with a haloorganyl phosphonic acid, e.g. chloroethyl phosphonate. The substituted amino di phosphonates, especially substituted amino bis(methylene phosphonates) are preferred.

The present invention also provides a process for the beneficiation of an ore comprising a metal oxide or oxide like compound, apart from those of tin or tungsten, which process comprises subjecting an aqueous slurry of said ore at pH 1.5–11, to froth flotation in the presence of at least one substituted amino phosphonic acid or salt thereof of general formula $R_aR^1_bR^2_cN(R^3PO_3H_2)_{3-a-b-c}$, and separating a fraction comprising beneficiated metal oxide or oxide like compound, from a second fraction depleted in said oxide or oxide like compound. The metal oxide and oxide like compounds are not cassiterite or wolframite and are usually water insoluble compounds which are incapable, when pure minerals in an aqueous slurry thereof at pH 9, of being floated in a froth flotation operation with 200 mg oleic acid per liter of slurry. The compounds are usually sulphur free, e.g. are not sulphides or sulphates.

DETAILED DESCRIPTION OF THE INVENTION

In the substituted amino phosphonate, the group R, preferably an alkyl group, especially contains 4–20 or 4–14 carbon atoms such as 6–12 carbon atoms., compounds in which group R has 6–10 or 6–9, e.g. 7–9 carbon atoms, give optimum results with columbite, niobite, monazite, hematite, smithsonite chromite and tantalite ores, while compounds with R an alkyl group of 9–14, e.g. 10–14 carbons may give optimum results with pyrochlore acid washed rutile, and uraninite ores. Thus group R may be a straight or branched chain group and may be a propyl butyl, amyl, hexyl, heptyl, octyl, nonyl, decyl, dodecyl group such as n propyl, isopropyl n butyl, sec butyl, n amyl, n hexyl, n heptyl, 5-methylhex-2-yl n-octyl, 2-ethyl hexyl, 6-methylhept-2-yl, isononyl, n-nonyl, lauryl, cetyl, oleyl or stearyl group; n heptyl, n octyl and 2-ethylhexyl groups are often preferred. Any branching in the chain is preferably at most 3 carbon atoms away from the free valency of the R group. In the alkenyl group the double bond is not attached to the carbon atom of the group R bearing the free valency. The substituent in the alkyl or alkenyl group may be an hydroxy group, an alkoxy group or dialkyl amino group, each alkyl being of, e.g. 1–12 carbon atoms; preferably the substituted alkyl group is an alkoxyalkyl group with 2–12 carbons e.g. 2,3,8, or 9 carbons in the alkoxy group and 2–6 carbons, e.g. 2 or 3 carbons in the alkyl group, such as 3-ethoxy propyl, 3-n butyloxy propyl, 3-(2-ethylhexyloxy) propyl or 3-(isononyloxy) propyl groups. Examples of the aralkyl group are hydrocarbyl ones of 7–13 carbons such as benzyl, methyl benzyl and ethyl benzyl, 1-phenylethyl and 2-phenylethyl, and hydroxy or alkoxy (e.g. methoxy) nuclear substituted derivatives of such hydrocarbyl groups. Examples of the aryl group are hydrocarbyl ones of 6–12 carbons such as phenyl, tolyl, xylyl and naphthyl. The cycloaliphatic group is usually hydrocarbyl with 5–7 carbon atoms as in cyclohexyl, while examples of hydrocarbyl cycloaliphatic alkyl groups are cyclohexyl methyl and 2 cyclohexylethyl.

The groups $R^1$ and $R^2$ which may be the same or different may be as described above for R, but preferably at least one is an alkyl group, preferably both are alkyl groups, in particular alkyl groups of 2–10, e.g. 3–8 carbon atoms with two alkyl groups, each of 4–6 carbons being preferred for purifying columbite, niobite, monazite, hematite, smithsonite, chromite and tantalite ores each of 5–8 carbons being preferred for purifying pyrochlore, acid - washed rutile and uraninite ores. Thus the $R^1R^2N$ may be derived from di alkylamines such as di butyl-, di pentyl-, di hexyl-, di 2ethylhexylamine or di cyclohexyl amines.

The group $R^3$ is a divalent organic group in which the two free valencies may be on the same or different carbon atoms. When they are on the same carbon atom, $R^3$ may be an alkylidene group, e.g. of 1–10 such as e.g. 1–3 carbon atoms as in methylene or ethylidene or isopropylidene, a cyclohexylidene group or an arylalkylidene group, e.g. of 7–19 carbons, e.g. a benzylidene or tolylidene group. When the valencies are on different carbon atoms $R^3$ may be an alkylene group of 2–10, e.g. 2 or 3 carbon atoms or an aryl alkylene group of 8 to 20 carbons such as 2-phenyl 1,2 ethylene group. Preferably $R^3$ is a methylene group.

The water soluble salts are usually ammonium or alkali metal, e.g. sodium or potassium salts. The compounds may be added to the flotation mediums as their free acids or as partly or completely neutralized salts or a mixture thereof.

In the process used to make the compounds in which $R^3$ has two free valencies on the same carbon, the reagents may be heated together at 50°–150° C., e.g. 50°–110° C., often for 0.1–4 hours, and often in a solvent, e.g. water. Preferably in order to stop competing reactions between the amine and the aldehyde or ketone, e.g. formaldehyde, the amine and phosphorous acid and/or phosphorus trichloride are mixed first and then the carbonyl compound, e.g. formaldehyde, added afterwards. The reaction is performed in acid solution with the acid, e.g. hydrochloric acid being added separately or made in situ from the phosphrous trichloride and water. At the end of the reaction, the product may be isolated as such or after treatment with a base, e.g. ammonia or ammonium hydroxide or an alkali metal hydroxide or carbonate, e.g. sodium hydroxide. However, as the substituted amino phosphonic acid or salts will be used in aqueous solution, it is preferably not isolated from the aqueous reaction product, but the aqueous solution is used as such or after dilution with water.

The metal oxide and oxide like compounds are usually ones in which the metal is a transition metal or lanthanide or rare earth or actinide metal, but may be a lithium aluminium silicate. The oxide and oxide like compounds are differentiated by their flotation behavior from mineral salts such as barite and fluorite which in aqueous slurry. at pH 9 are capable of being floated with 200 mg/l of oleic acid collector.

Examples of the oxide or oxide like compounds are transition, lanthanide or actinide metal oxides as such, such as ironoxide, e.g. as haematite, titanium dioxide, e.g. rutile, uranium oxide, e.g. as uraninite and thorium dioxide, e.g. a thoria (often mixed with phosphates as in monazite), or "mixed metal oxides", e.g. "mixed transition metal oxides", such as those of iron and/or manganese with either niobium, tantalum or chromium as in columbite, tantalite, niobite and chromite, or niobate and/or tantalate salts such as those with calcium and sodium as in pyrochlore or vanadates such as those of uranium, potassium or lead, e.g. pitchblende, carnotite or vanadinite. The mixed metal oxides, niobates tantalates chromites and vanadates are examples of salts with transition metals in the anion, which may be generally used, apart from wolframite. Other oxide like compounds, which behave like oxides in froth flotation towards anionic collectors are some silicates such as zircon (zirconium silicate), garnierite (a nickel magnesium silicate), hemimorphite (a zinc silicate), petalite and spodumene (lithium aluminum silicates) and some carbonates such as smithsonite (a zinc carbonate), as well as some phosphates such as rare earth metal phosphates, e.g. monazite (cerium lanthanum and yttrium phoshates).

Thus the oxide or oxide like compounds are usually oxides, carbonates or phosphates of transition, actinide or lanthanide metals, or "mixed metal oxides"(or salts thereof) containing metals of atomic number of 73 or less. Advantageously, they are transition metal oxides such as acid washed rutile or the "mixed metal oxides" (or salts thereof with alkali or alkaline earth metals) especially those with Group VA transition metals (i.e. V, Nb, Ta) or chromium, or zinc carbonate such as smithsonite, or lanthanide metal phosphates such as monazite. Most preferably the oxide or oxide like compounds are the "mixed metal oxides" (or salts thereof), smithsonite and monazite.

The ores to be beneficiated may comprise 0.1–50%, e.g. 1–30% by weight of the oxide or oxide like compound, usually admixed with undesirable compounds such as quartz or silicates such as feldspar, mica, tourmaline or chlorite. The flotation process enables separation of the oxide or oxide like compound from these undesirable silicates. The ores may be found, e.g. in Australia, Brazil, Canada, USA, USSR or Zaire. While it is usually the oxide or oxide like compound which is preferentially floated away from the contaminants, e.g. quartz and silicates, in some cases particularly with calcite, under alkaline conditions the calcite is preferentially floated away from the oxide or oxide like compound, e.g. monazite.

Normally, prior to being subjected to a flotation process in the presence of the substituted amino phosphonic acid collector, the ore is ground and then classified at less than 75μ, e.g. less than 50 or 60μ. The slimes (i.e. particles of a size less than 15, 10 or 5, μ) are normally separated by cyclone classification technique. The ore is also normally subjected, before or after the desliming stage, to a preliminary froth flotation with a sulphur containing collector, e.g. a xanthate salt such as potassium ethyl or amyl xanthate in order to remove the sulphide values of the ore. Thus the oxide ore is fine grained, deslimed and substantially sulphide free.

The ore in the form of an aqueous slurry usually of particles of 10–75μ size is then subjected to a froth flotation process in the presence of the substituted amino phosphonic acid or salt described above. In the flotation cell the aqueous slurry is treated with air to form a froth in which the oxide or oxide like compound usually becomes concentrated leaving usually a higher proportion of gangue behind in the aqueous tailings phase. The froth is separated and oxide or oxide like compound recovered. Any suitable frothing agent may if desired be employed to reduce the surface tension at the liquid air interface. Examples of frothing agents are liquid aromatic hydrocarbons of 6–10 carbons such as benzene, toluene or xylene, alcohols, e.g. alkanols, of 4–18, e.g. 6–12 carbon atoms, polyglycol ethers, polypropylene glycols, phenols and alkyl benzyl alcohols. However, in view of the surface active properties of the higher alkyl (e.g. 6–20 carbon) substituted aminophosphonic acids, it is often possible to carry out the flotation without recourse to the addition of a foaming or frothing agent. After the amino diphosphonate has been added to the slurry of ore, there is usually a delay, e.g. of 0.1–10 minutes, e.g. 0.5–4 minutes such as 1 or 2 minutes to permit conditioning of the ore before the start of the frothing.

The flotation process is usually carried out at a pH of 1.5–8, such as 2–8, normally of 4–7.5 and especially 4.5–5.5, for flotation of the oxide or oxide like compound away from quartz and silicates, with the exception of smithsonite and pyrochlore where alkaline conditions are preferred. The pH may be adjusted by addition of an alkali (such as caustic soda) or acid (such as sulphuric acid).

These compounds may be employed in amounts depending upon the content of the ore of the oxide or oxide like compound to be recovered and the presence of interfering ions and/or minerals, increases in all of which necessitate increases in amount of collector. At least an effective amount of the collector is usually used. Generally the concentration of the amino phosphonate collector in the slurry is 25–500, e.g. 50–500 or 150–300 mg/l. The amount of collector may be 50–1000 g, e.g. 100–400 g, especially 150–250 g, per tonne of ore solids in the slurry in the first flotation treatment to which the ore has been subjected. Thus if the ore is subjected to a froth flotation to remove sulphide then the amount of amino phosphonate is expressed per tonne of the ore going into that sulphide pretreatment. Likewise if there is no prior froth flotation to remove sulphide or e.g. carbonate, then the amount of amino phosphonate is expressed per tonne of ore going to the first amino phosphonate flotation. The solids content of the slurry is usually 20–45% by weight.

The frothing step may be performed for 1–60 minutes, e.g. 1–10 minutes. Once the oxide or oxide like compound has been floated it remains on the surface of the liquid in the flotation vessel in the form of a froth which may be removed by mechanical means and the oxide or oxide like compound recovered therefrom. Hence in that process the aqueous slurry of ore is subjected to a froth flotation process which produces a froth comprising a purified fraction of higher content of oxide or oxide like compound than the ore and an aqueous phase comprising tailings of lower content of oxide or oxide like compound than the ore. Examples of such processes are the froth flotation or ores comprising columbite, niobite, tantalite, chromite or monazite in the presence of the alkylamino diphosphonate compounds in which the alkyl group contains 7–9 carbons, e.g. at pH 5–7.

However, reverse flotation may also be used in which the beneficiated ore is in the tailings, not the froth. Thus it is possible, e.g. in the case of ore containing calcite and an oxide or oxide like compound which floats less well than calcite, e.g. monazite or pyrochlore, for the froth to comprise the lower purity fraction with calcite and the tailings aqueous phase to comprise the higher purity fraction, the calcite may be separated from monazite at pH 8–11 with the diphosphonates with R a 7–9 carbon alkyl group, or from pyrochlore or uraninite at pH 3–11 with the diphosphonates with R an alkyl of 8 or less carbons, e.g. 6–8 carbons. Other examples of potential use of this reverse flotation technique are the separation of gangue minerals such as hematite, garnet, tourmaline and chlorite with the froth from aqueous tailings containing pyrochlore, rutile or uraninite and alkyl substituted amino diphosphonates with $C_{8-9}$, e.g. $C_{7-9}$ alkyl substituents at e.g. pH 4–8.

In the general case, the froth flotation process of the invention produces 2 phases, a froth phase of product of one purity and an aqueous phase of product of a second purity, and the phases are separated and the product of higher purity recovered.

When the froth comprises the purified product, the collector may be added in more than 1 portion, e.g. 2–4 with the froth being separated after each addition, the froth fractions being successively less purified with respect to gangue materials. This technique may be advantageous when the collector concentration is low giving high selectivity, but low recovery in each step; keeping the collector concentration low and adding more successively can give overall high recovery as well as the high selectivity.

Some of the substituted amino phosphonic acid collectors, e.g. those in which the group R is an alkyl group of 6–9 carbon atoms, may show a selectivity in froth flotation for the oxide or oxide like compound over tourmaline and/or chlorite, both minerals often occurring with such compounds. Thus differential froth flotation can be used to purify the ore.

The substituted amino phosphonic acid collectors may be used alone or mixed with one another or mixed with other collectors such as fatty acid salts, e.g. as oleic or linoleic acid salts or an alkyl phosphonic acid, e.g. as octyl phosphonic acid or styrene phosphonic acid or sulphonates, sulphates, e.g. alkyl sulphosuccinates or alkyl sulphosuccinamates.

In order to improve the selectivity of the flotation for the oxide or oxide like compound over gangue materials and/or to increase the recovery of oxides or oxide like compound, pretreatments and/or precleaning operations may be performed. Examples of pretreatment are attrition, conditioning with the amino diphosphonate and/or depressants for, e.g. iron, and addition of sodium silico fluoride as a depressant for iron silicates; addition of activators, e.g. di or tri valent metal salts such as lead or aluminium salts may be made. Prewashing with dilute acid may be used with the oxide or oxide like compounds stable thereto to help reduce any adverse influence of iron on the flotation. The precleaning operation is part of the froth flotation involving the amino phosphonate with the first froth flotation operation giving a first froth and a first tailings and the first froth being diluted with water and then refrothed to give a second purer froth and a second tailing. The metal oxide or oxide like compound content of the second froth is recovered and the second tailings are recycled to the first froth flotation step or to the step of slurrying the ore. Solids are separated or allowed to separate from the first tailings and the aqueous mother liquor recycled to the first or second froth flotation step. If desired, a third flotation step may be performed. In each froth flotation step the flotation may take place in 1 or more cells in parallel; usually in the first rough flotation step 3–8 such as 4–6 cells are used while 1 or 2 cells may be sufficient for the second and any subsequent steps. In order further to aid selectivity (i.e. upgrading of the ore), any or each froth flotation step may include deep froth flotation, in which only the uppermost part of the froth (with the highest enrichment) is removed, with the rest of the froth being recycled to the froth flotation cell from whence it came. Pretreatment to depress the action of iron and two or more consecutive froth flotation operation are highly beneficial. Pretreatment with dilute acid on rutile ores is particularly beneficial, especially with oxidized ores.

Specific Examples of the beneficiation by froth flotation that may be performed and the specific conditions are as follows with the alkylimino bis (methylenephosphonates) with alkyl of 4–9 carbons, especially 7–9 carbons, at 50–500, e.g. 100–200 mg/l concentration of collector and especially in the presence of silicate depressants; columbite or tantalite from quartz and silicates at pH 2–6.5 or 3.5–7.5 especially 4–7 or 5–7; hematite from quartz dolomite and chlorite at pH 2–3 and 4.5–8, also from tourmaline and garnet at pH 4.5–8 and from calcite at pH 2–3; monazite from silicates at pH 4–6.5 or from quartz at pH 4–7; chromite from quartz and silicates at pH 3.5–8, e.g. 5–7 such as 5.5–7 especially as 6–7 (silicate depressants optional and amounts of collector of 50–150 mg/l may be beneficial); smithsonite from quartz and silicate at pH 7–11, e.g. 7–10, from dolomite at pH 8–11 and from apatite at pH 9–11 with amounts of collector usually of 100–500 mg/l; acid washed rutile from quartz and silicates at pH 4–6; fluorite from pyrochlore at pH 2–7; calcite from monazite at pH 8–11 or from pyrochlore or uraninite at pH 4–7. While the alkyl group R may be butyl, amyl or hexyl, it is very advantageously n heptyl, n octyl, 2-ethyl hexyl or isononyl. Other specific examples of froth flotations and the conditions with alkylimino bis (methylene phosphonates) with alkyl of 10–14 carbons at 50–500, e.g. 100–200 mg/l concentration of collector, especially in the presence of silicate depressants are acid washed rutile from quartz and silicates at pH 3–10, e.g. 5.5–10 and pyrochlore from silicates and quartz pH 8–11, e.g. 8–10.5, particularly with the dodecyl compound. The reverse flotation of hematite from columbite, tantalite, rutile, monazite, pyrochlore and uraninite may be performed with the 4–8 carbon alkyl compounds at pH 2–7 especially at 20–100 mg/l collector concentration. While pyrochlore may be floated from silicates with the long chain compounds, it often contains fluorite which is preferentially floated. The fluorite may be floated in a pretreatment with a lower alkylimino bis methylene phosphonate or a fatty acid to leave in the tailings the pyrochlore and silicates, and then the tailings may be treated with the long chain alkyl imino compounds to float the pyrochlore and leave the silicate in the tailings.

The invention is illustrated in the following Examples, in Example 1–19 of which the term "full flotation" in these Examples means that the agglomerated particles of mineral are carried to the surface of the liquid with some retention of them at the surface, and the term "three quarters flotation" means that the agglomerated particles are carried to the surface of the liquid, but with no retention thereof at the surface.

EXAMPLES 1—3

Vacuum flotation tests were carried out in 30 ml glass tubes attached to a vacuum pump. Samples (200 mg) of pure columbite mineral of 150–75μ size were mixed with aqueous solutions (25 ml) of the pH over the range of 4–10 containing the collector specified below. After 10 minutes, a vacuum was applied to the tubes and flotation was then assessed to have occurred when flocculated mineral was observed to have been floated by the precipitated air bubbles. The collector was of formula RN $(CH_2\ PO_3Na_2)_2$ where R was n-octyl. The minimum amount of the collector needed to effect full flotation of the mineral at each of the quoted pH's was noted. With concentrations of collector in the range 10–200 gm/l, flotation only occurred at pH 4–6.5 with a collector concentration of 100 mg/l or more.

The same results were found with tantalite instead of columbite.

The same results were found with monazite instead of columbite.

EXAMPLES 4 AND 5

The procedure of Examples 1–3 was repeated with haematite instead of columbite. The haematite floated at pH 4–7.5 at all concentrations of collector in the range at 10–200 mg/l.

EXAMPLES 6 AND 7

The procedure of Examples 1–3 was repeated with smithsonite (zinc carbonate) and monazite. The amount of collector needed to effect three quarters flotation of the mineral at the various pH levels were as follows.

| mg/l | Smithsonite | Monazite |
|---|---|---|
| 200 | 6.8–10.5 | 4–7.5 |
| 100 | 6.9–7.8 | 4.5–7 |
| 50 | 7.4 | 5–6 |

Flotation of substantially all the monazite occurred at 200 mg/l concentration at pH 4.9–5.7.

The smithsonite may thus be separated from dolomite at above pH 8 and from silicate minerals at above pH 7 (see Comparative Examples below).

COMPARATIVE EXAMPLES

In a similar manner to that of Example 1, various gangue minerals often associated with the minerals of Example 1–7 were also tested. The minerals were dolomite, calcite, apatite, garnet, tourmaline, chlorite, quartz. The amounts of collector needed for three quarters flotation of the mineral at the pH figures were as follows.

| mg/l | pH Dolomite | Calcite | Apatite | Garnet | Tourmaline | Chlorite |
|---|---|---|---|---|---|---|
| 200 | 4.5–8 | 2.5–10 | 2.5–9 | 2–8 | 2–7 | 2–11 |
| 100 | 5–8 | 3–10 | 3.5–8.8 | 2–7 | 2–6.5 | 3–8 |
| 50 | 5.5–8 | 3.5–9.5 | 4.2–8.2 | 2–7 | 2–6 | 4–7 |
| 20 | 6.5–7.5 | 3.8–8.5 | 5.5–6.5 | 2–8 | 2–6 | — |
| 10 | — | 4.2–7.5 | — | 2–7 | 2–5.8 | — |

The results for full flotation of the minerals were as follows:

| mgl/l | pH Calcite | pH Garnet | pH Tourmaline |
|---|---|---|---|
| 200 | 3–6 | 2–7 | 2–4.1 |
| 100 | 4–5 | 2–6 | 2–4.1 |
| 50 | | 2–6 | |
| 20 | | 2–7 | |

Essentially no flotation occurred at pH 2–11 with amounts of collector of 200 mg/l or less with quartz and garnierite.

EXAMPLES 8–10

The procedure of Example 1–3 was repeated with haematite, columbite, chromite and tantalite. The results for three quarters flotation of the minerals were as follows.

| mg/l | pH Haematite | pH Columbite | pH Chromite | pH tantalite |
|---|---|---|---|---|
| 200 | 2*–6.5,* 6.5–8.3 | 2–7 | 3.5–8 | 3.3–7.4 |
| 100 | 2*–7,* 7–8.1 | 2–7 | 4.2–7.5 | 3.6–7 |
| 50 | 2*–7.2* | 2–3 | 5–7 | 5.4 |
| 20 | 2*–7.5* | | 5.5–7 | |
| 10 | 2*–7.5* | | 5.5–7 | |

In the haematite results, the asterisk denotes full flotation.

EXAMPLES 11-14

The procedure of Examples 1-3 was repeated with a first sample of rutile, and also with a second sample of rutile, after it had been washed with dilute sulphuric acid for 30 mins. at pH 2.2. The experiments on both samples were done with the amino diphosphonate collector wherein R is a n-octyl, and ones on the acid washed sample were also done with corresponding alkyl amino diphosphonate collectors in which R was isononyl and n-dodecyl only studied at pH range 3.5-11. The results for three quarters flotation were as follows.

| First-sample | | Second-sample | | |
|---|---|---|---|---|
| mg/l | n-octyl | n-octyl | isononyl | dodecyl |
| 200 | 4.5-8 | 2-7 | 2-11 | 5:5-10.1 |
| 100 | | 2-6.2 | 2-10.4 | 3.5-9.9 |
| 50 | | 2-5.4 | 2-9.5 | 3.5-9.5 |
| 20 | | | | 3.5-8.4 |
| 10 | | | | 3.5-5.4 |
| full float | | | | |
| 200 | | 3.8-5.3 | 5.3-10.1 | 5.5-9.8 |
| 100 | | | | 3.5-9.1 |
| 50 | | | | 3.5-9.5 |
| | | | | 6-8 |

EXAMPLES 15-17

The procedure of Examples 1-3 was repeated with pyrochlore and the n-octyl, isononyl and dodecyl derivatives. The results for three quarters flotation were as follows.

| mg/l | n-octyl | isononyl | dodecyl | dodecyl full-flotation |
|---|---|---|---|---|
| 200 | Nil | 7.3-10 | 7.1-11 | 8.3-9.4 |
| 100 | | | 7.3-11 | 8.5-10.2 |
| 50 | | | 7.4-11 | 9.2 |
| 20 | | | 7.8-9.9 | |
| 10 | | | 8-9 | |

EXAMPLES 18 AND 19

The procedures of Examples 1-3 was repeated with uraninite (uranyl oxide) and the n octyl, isononyl and dodecyl derivatives. The results for three quarters flotation were as follows.

| mg/l | n-octyl | isononyl | dodecyl |
|---|---|---|---|
| 200 | Nil | 10-10.7 | 9.5-11 |

EXAMPLE 20

In this Example the expression kg/tonne used in connection with amounts of modifier collector etc. means the amount expressed per tonne of the original ore sample before grinding.

A 1 kg sample of pyrochlore ore from Canada containing about 0.54% Nb (of which only about a half was available for recovery by flotation as a highly enriched product) as well as silicates, fluorite and quartz was beneficiated as follows. The ore of particle size passing a 1.7 mm screen was wet ground for 35 minutes in a rod mill in 50% solids aqueous slurry containing 0.5 kg/tonne sodium silicate. The pulp obtained was deslimed three times in a laboratory cyclone to separate slimes of nominal 0.01 mm size from an aqueous slurry. The pH of the aqueous slurry was adjusted to 9.5 with sodium hydroxide, diluted with water to a 30% solids concentration and 0.5 kg/tonne sodium silicate was added followed by 5 minutes conditioning with sodium oleate in amount of 0.3 kg/tonne and then 2 minutes froth flotation with air and separation of the froth as a fluorite concentrate from the aqueous slurry. No extra frothing agent was added. To this slurry was added as collector 0.2 kg/tonne of n-dodecyl imino bis (methylene phosphonic acid) (added in aqueous solution as a sodium salt) with 2 minutes conditioning before 2 minutes froth flotation with air, separation of the froth as concentrate 1 and the collector addition, conditioning, froth flotation and separation of froth repeated twice more to give concentrates 2 and 3 respectively and final tailings. The fluorite concentrate, concentrates 1, 2 and 3 and tailings were each dried, weighed and analyzed for Nb. The results were as follows.

| | wt % | % Nb | % Distribution of Nb |
|---|---|---|---|
| Fluorite conc. | 12.40 | 0.76 | 17.6[x] |
| Concentrate 1 | 10.84 | 0.89 | 18.0 |
| Concentrate 2 | 20.31 | 0.75 | 28.5 |
| Concentrate 3 | 14.80 | 0.54 | 14.9 |
| Tailings | 41.65 | 0.27 | 21.0[x] |
| | 100.00 | (0.54) | 100.0 |

[x]These fractions contained the majority of the niobium containing mineral which cannot be physically separated from gangue mineral.

We claim:

1. A process for the beneficiation of an ore comprising a lanthanide compound which is a lanthanide metal oxide, a lanthanide metal carbonate or a lanthanide metal phosphate, which comprises subjecting an aqueous slurry thereof at pH 1.5-11 to froth flotation in the presence of a sufficient amount of at least one substituted amino phosphonic acid or salt thereof to act as a collector wherein said substituted amino phosphonic acid or salt thereof is represented by a formula $R_aR_b^1R_c^2N(R^3PO_3H_2)_{3-a-b-c}$ wherein each of R, $R^1$ and $R_2$, which are the same or different, represents an organic group, $R^3$ represents a divalent organic group and each of a, b and c represents 0 or 1, but when a is 1, b and c are 0 and when a is 0, b and c are 1, and separating a beneficiated fraction comprising said lanthanide compound from a second fraction depleted in said lanthanide compound.

2. A process according to claim 1, wherein a is 1, b and c are 0 and $R^3$ is a methylene group.

3. A process according to claim 2, wherein R is an alkyl group.

4. A process according to claim 3, wherein the ore comprises a lanthanide metal oxide, carbonate or phosphate.

5. A process according to claim 4, wherein the ore comprises monazite.

6. A process according to claim 5, wherein the ore is subjected to froth flotation at a pH of 5 to 7.

7. A process according to claim 5, wherein R is an alkyl group of 4-10 carbon atoms, a is 1, b and c are 0 and $R^3$ is methylene.

8. A process according to claim 5, wherein R is alkyl group of 7-9 carbon atoms, a is 1, b and c are 0 and $R^3$ is methylene, and said beneficiated fraction comprising the lanthanide compound is separated in the froth from said second fraction which comprises tailings.

9. A process according to claim 1, wherein R is an alkyl group of 4–10 carbon atoms, a is 1, b and c are 0 and $R^3$ is methylene.

10. A process according to claim 1, wherein R is an alkyl group of 7–9 carbon atoms, a is 1, b and c are 0 and $R^3$ is methylene, and said beneficiated fraction comprising the lanthanide compound is separated in the froth from said second fraction which comprises tailings.

11. A process according to claim 1, wherein the substituted amino phosphonic acid salt is $RN(CH_2PO_3Na_2)_2$, wherein R is selected from the group consisting of n-octyl, isononyl and n-dodecyl, and the ore is subject to froth flotation at a pH of 5 to 7 and said beneficiated fraction comprising the lanthanide compound is separated in the froth from said second fraction which comprises tailings.

12. A process according to claim 11, wherein the ore comprises monazite.

13. A process according to claim 1, wherein the substituted amino phosphonic acid is $RN(CH_2PO_3Na_2)_2$, R is n-octyl, and the ore comprises monazite, the ore is subject to froth flotation at a pH of 5 to 7 and said beneficiated fraction comprising said lanthanide compound is separated in the froth from said second fraction which comprises tailings.

14. A process according to claim 1, wherein the substituted amino phosphonic acid salt is $RN(CH_2PO_3Na_2)_2$ and R is selected from the group consisting of n-octyl, isononyl and n-dodecyl.

15. A process according to claim 14, wherein the ore is subject to froth flotation at a pH of 5 to 7.

* * * * *